United States Patent [19]

Feinberg et al.

[11] Patent Number: 4,568,860

[45] Date of Patent: Feb. 4, 1986

[54] RAPID START FLUORESCENT LAMP CIRCUITS WITH DISCONNECT SOCKETS

[75] Inventors: Albert E. Feinberg, Chicago; Robert W. Wisbey, Arlington Heights, both of Ill.

[73] Assignee: Advance Transformer Co., Chicago, Ill.

[21] Appl. No.: 523,961

[22] Filed: Aug. 17, 1983

[51] Int. Cl.[4] ..... H05B 41/16

[52] U.S. Cl. ..... 315/255; 315/99; 315/105; 315/278; 315/323

[58] Field of Search ..... 315/278, 255, 323, 123, 315/127, 125, 105, 340

[56] References Cited

U.S. PATENT DOCUMENTS

| | | | |
|---|---|---|---|
| 2,552,111 | 5/1951 | Peterson | 315/189 |
| 2,767,349 | 10/1956 | Feinberg | 315/97 |
| 2,853,653 | 9/1958 | Williams | 315/323 |
| 3,040,208 | 6/1962 | Feinberg | 315/255 |
| 3,324,349 | 6/1967 | Moerkens et al. | 315/323 |

*Primary Examiner*—Harold Dixon

*Attorney, Agent, or Firm*—Silverman, Cass & Singer, Ltd.

[57] ABSTRACT

A two-lamp rapid start fluorescent lamp circuit in which the lamps are ignited in sequence and then operated in series. The circuit being energized from a low voltage a.c. source through the use of a substantially conventional ballast which utilizes a transformer having a primary winding and a secondary winding connected in autotransformer relationship. The circuit includes a disconnect socket and a conventional two contact socket for mounting each lamp. The disconnect sockets in one circuit are arranged in one example to open the connections between the filament windings and a filament of each lamp. In another circuit one disconnect socket is arranged to open a connection to a filament winding and the other disconnect socket is arranged to open one of the connections to the line.

7 Claims, 4 Drawing Figures

RAPID START FLUORESCENT LAMP CIRCUITS WITH DISCONNECT SOCKETS

FIELD OF THE INVENTION

The field of this invention is circuitry for fluorescent lamps and more particularly this invention is concerned with circuits for the so-called rapid start fluorescent lamps connected to ignite seriatim and operate in series.

BACKGROUND OF THE INVENTION

The circuit for energizing and operating the rapid start fluorescent lamp in wide use is well-known. The majority of such lamps are rated at 40 watts and are dimensioned as T-12, that is, 1½ inches in diameter and 48 inches long. Each lamp has a filament of robust construction at each end which is energized continuously. The filaments aid in starting by producing clouds of electrons at the ends of the lamp and contribute to the reliability of the lamp operation.

The 40 watt T-12 rapid start lamp ignites at about 200 volts R.M.S. and operates at about 102 volts R.M.S. The ballast for energizing and operating two lamps is conventionally constructed to apply about 300 volts to each lamp seriatim and revert from a starting circuit to an operating circuit automatically.

Because each lamp has two pins at each end it was heretofore deemed that the particular circuit which is practically universally used was safe to humans who might be inserting or changing lamps while the circuit was energized. It was considered that if the voltage to ground through a lamp, that is, with one end held by a person and the other end in a socket, did not exceed 180 volts R.M.S. or 325 volts peak, the person would not be subjected to shock hazard.

Tests by Underwriters' Laboratories have now raised some doubt that the conventional rapid-start fluorescent lamp circuit is totally safe when one end of a lamp is grasped by a person and the opposite end inserted into a socket. This assumes that the circuit is energized. As a result U.L. has required that until the lamp has been firmly seated in its sockets there be no current flow exceeding 5 m.a. and that there be no likelihood that the lamp ignite.

This problem of ensuring the safety of rapid-start lamps has been considered in prior circuitry disclosed in U.S. Pat. Nos. 2,767,349 and 3,040,208. None of the circuits of these prior art patents taught how to utilize disconnect sockets in a two-lamp series circuitry of the type where there is a single primary and a single secondary connected in economical autotransformer arrangement.

The invention achieves the required safety against shock hazard by the use of novel circuits including disconnects, this being achieved with great economy. Economy is an essential requirement because the slightest increase in basic cost of a circuit is elevated in the eventual cost to the user.

Until the invention herein it was not deemed economically possible to use disconnect sockets in a two-lamp rapid start fluorescent lamp circuit while preserving the autotransformer connection of transformer windings. The addition of disconnect sockets to a two-lamp rapid start fluorescent lamp circuit could only be accomplished by isolating the primary and secondary windings and making the connections somewhat like those used in a known instant start circuit (U.S. Pat. No. 2,552,111). This would require a complete rearrangement of the ballast circuitry and thus a radical departure from the economical manufacture of the modern two-lamp rapid start fluorescent ballast of today. Voltages to ground would be different as well as starting aid voltages. Industry requirements of today could not be met.

As will be seen from the specification herein the invention achieves the required safety without radically changing the construction of the two-lamps rapid start fluorescent lamp ballast thereby enabling the same methods of manufacture to be used. The circuitry is varied by miniscule changes in connecting the ballasts in the fixtures and/or during installation into connection with a line. All voltages to ground are preserved.

SUMMARY OF THE INVENTION

Circuit for energizing a pair of rapid-start fluorescent lamps from a low voltage a.c. source in which the lamps are ignited in sequence and operated in series utilizing a substantially conventional two-lamp rapid start fluorescent lamp ballast having a primary winding and a secondary winding in autotransformer connection.

The circuits of the invention are characterized by the use of two disconnect sockets in each circuit, at least one of which is arranged to keep a filament of the second-to-ignite lamp open until the second-to-ignite lamp is wholly within its socket. One circuit of the invention has the second disconnect socket arranged to keep a filament of the first-to-ignite lamp open while another circuit of the invention has the second disconnect socket arranged to keep the line open. The presence of the first-to-ignite lamp fully within its sockets will complete the respective connections to the filament winding and line in the latter instances.

DESCRIPTION OF THE PREFERRED EMBODIMENTS

The conventional two-lamp rapid start fluorescent lamp circuit will be described first in connection with FIG. 1 because the embodiments of the invention comprise modifications of the known circuit to reduce, if not eliminate, shock hazard in the servicing of such circuits.

Figure 1:
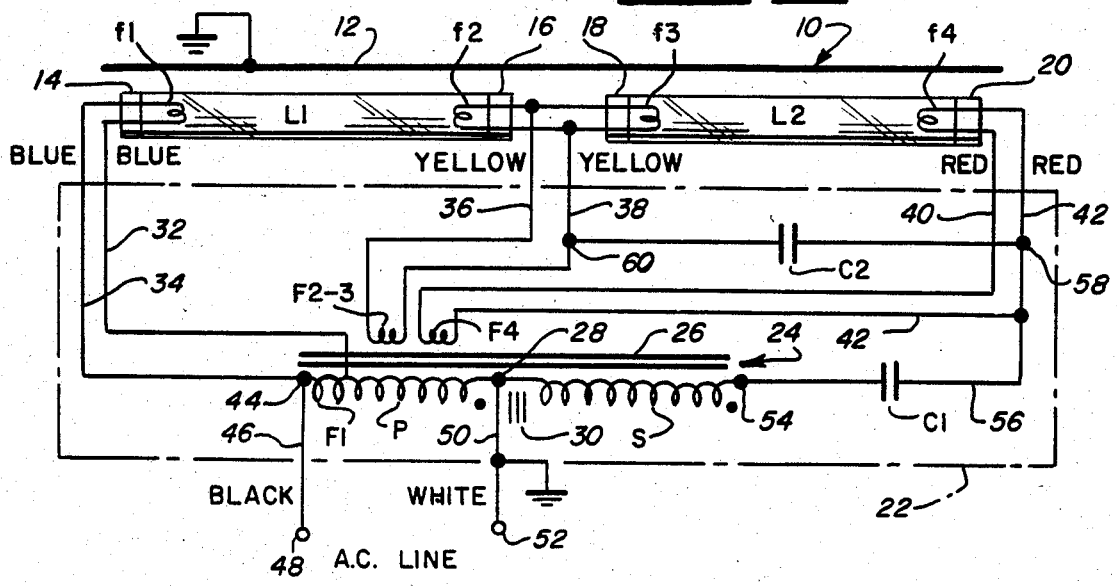
FIG. 1 PRIOR ART
FIG. 1 is a circuit diagram of a conventional prior art two-lamp rapid start fluorescent lamp circuit.

The circuit 10 of FIG. 1 as used in commercial and domestic structures comprises a fixture, a ballast wired into the fixture and electrical leads connecting the circuit between its electrical components including leads connecting the same to an a.c. source of low voltage. The normal line voltage with which 40 watt T-12 rapid start lamps are used is 120 volts 60 hertz although circuits exist for connecting the same to somewhat higher voltages. The line frequency outside of the United States is 50 hertz which requires slight modification of the ballast.

The fixture may have any design, but all have in common a grounded metal plate 12 which is close to the two lamps L1 and L2 as an aid in starting. The lamps have filaments in their ends as at f1, f2, f3 and f4 and these are connected with external pins, a pair at each end, secured in sockets such as 14, 16, 18 and 20 mounted to the fixture. A ballast 22 is mounted to the fixture and has leads extending to the sockets and to the line.

The ballast 22 is a metal canister whose body is grounded and on the interior of which are disposed the windings and condensers of the circuit as well as other components not pertinent to this discussion, as for example, bleed resistors and radio interference condensers. All interior components are potted in a solidifed potting compound and insulated from the canister body. The exterior of the canister has a permanent label which includes amoung other information a diagram explaining the exact manner in which the ballast is to be connected into the circuit.

The rapid start ballast 22 has a transformer 24 mounted on a laminated iron core 26 comprising a primary winding P and a secondary winding S connected in autotransformer relationship at the junction 28, the windings being separated by a shunt 30 to provide a high leakage reactance in the secondary circuit during operation. A few turns of the primary winding P serve as a filament winding F1 and connect by way of leads 32 and 34 to the filament f1 through the socket 14 to energize said filament f1 during operation of the circuit 10. Two additional filament windings F2-3 and F4 are closely coupled to the primary winding P and serve the other filaments. F2-3 connects by way of leads 36 and 38 to the jumpers extending between sockets 16 and 18 and thus energize both filaments f2 and f3; F4 connects by way of leads 40 and 42 to the socket 20 to energize the filament f4.

The primary winding terminal 44 is common to the lead 34 and the lead 46 which extends to one terminal 48 of the line. In the conventional circuit 10 this will be the "hot" side of the line. The terminal 28 extends by way of the lead 50 to the grounded side of the line and to terminal 52. The secondary winding S has its right hand terminal 54 connected by way of the lead 56 through the running condenser C1 to the junction 58 in the lead 42. A starting condenser C2 is connected to by-pass the lamp L2 from the juncture 58 to the juncture 60 in lead 38. A consideration of the connections and leads as well as the polarity markings of the windings P and S shows that the windings are in additive series arrangement in a loop including the lamps L1 and L2 as well as the condenser Cl.

The electrical leads extending from the ballast 22 are color coded according to standards established in the United States. Thus, there are eight leads extending from the conventional ballast 22, two blue (32, 34) two yellow (36,38) two red (40, 42) and the black and white leads 46 and 50 extending to the line.

On open circuit the voltage across the secondary winding S (with the primary winding connected to a 120 volt line) is 180 volts. When added to the primary voltage of 120 volts, the resulting 300 volts is normally less than required to start lamps L1 and L2 in series because each lamp requires a minimum of 200 volts to start it. The condenser C1 is conventionally 3.9 microfarads and the condenser C2 is 0.05 microfarads. On open circuit with no current flowing the voltage from terminal 44 to terminal 54 will be connected by way of the condensers C1 and C2 across lamp L1. The condensers add no reactance to the circuit with no current flowing.

The 300 volts is sufficient to start lamp L1 and current now appears in the circuit. The voltage across condenser C2 now becomes a high value as a result of which a voltage appears across the lamp L2 sufficient (with the aid of the plate 12) to start lamp L2. When lamp L2 ignites, its internal resistance is so much lower than the reactance of condenser C2 that practically all current thereafter flows through lamp L2 to the exclusion of condenser C2.

The lamp L1 and L2 are now connected in a series loop with condenser C1 and the windings P and S. The operating voltage of the 40 watt rapid start fluorescent lamp is about 101 or 102 volts or 202 to 204 volts for two lamps in series which is readily furnished by the transformer 24. It will be recalled that this is a high leakage reactance transformer so that the stability of the series circuit of lamps L1 and L2 is ensured. The running condenser C1 now furnishes the necessary capacitive reactance for operation of the circuit.

Now, consider what happens if a person should handle the lamps with the circuit energized.

With lamp L1 in place, if the pins of lamp L2 filament f4 are held by a person and the pins of filament f3 are engaged in socket 18, lamp L2 could start because voltage appears across condenser C2. The current to ground through the person would be about 3.4 milliamps which would not be fatal to a healthy person, but frightening. This is because current flow is limited by the condenser C2.

With lamp L1 in place if the pins of lamp L2 filament f3 are held by a person and the pins of filament f4 are engaged in socket 20, lamp L2 could ignite. The current flow is now limited only by condenser C1 to 265 milliamps or more, which could be fatal.

With lamp L2 in place if a person holds the pins of filament f2 of lamp L1 and engages the pins of filament f1 in socket 14 the maximum voltage across the lamp L1 would be 120 volts to ground and insufficient to ignite the same. Thus nothing would happen.

If a person held the pins of filament f1 of lamp L1 and engaged the pins of filament f2 of lamp L1 in socket 16, the result would depend upon the condition of lamp L2. If lamp L2 is out of the circuit the lamp L1 may ignite but since current is limited by the presence of condenser C2 only 3.4 milliamps will flow. If however lamp L2 is in the circuit both lamps could ignite and a fatal current could flow.

Disconnect sockets cannot be used in a conventional manner because the lamps are connected in series as previously explained without radical ballast re-design.

Figure 2:
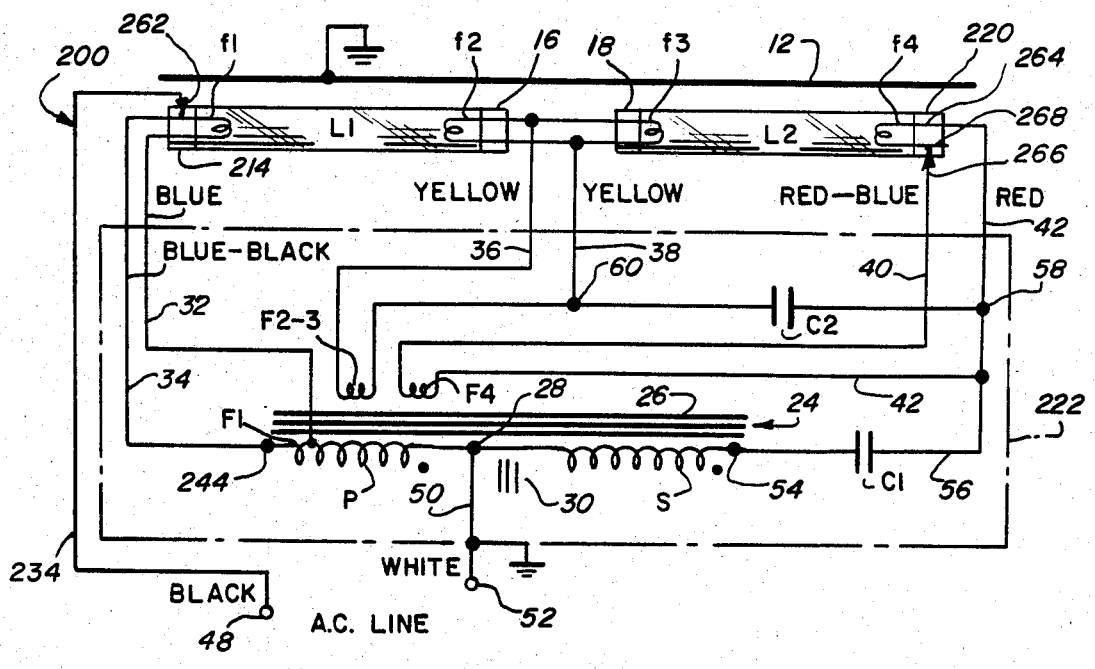
FIG. 2 is a circuit diagram of a two-lamp rapid start fluorescent lamp circuit comprising one embodiment of the invention.

In FIG. 2 there is illustrated a circuit 200 which solves the problem described above. In the circuit 200 the transformer with its winding can be identical to the transformer of prior art circuit 10; hence the same reference characters are used in this drawing as used in FIG. 1 for the transformer and windings. Like or equivalent components carry the same reference characters throughout all of the figures so far as feasible.

The basic principle of the invention as carried out in the several embodiments illustrated and described is that if a filament in a rapid start lamp is not energized the lamp cannot ignite at the voltages to which it is subjected in a two-lamp rapid start fluorescent lamp circuit. Additionally, if the transformer terminal lead to a lamp can be kept open until the lamp is fully seated in its disconnect socket the lamp cannot ignite.

In the circuit 200 the left hand end of lamp Ll which ignites first, is engaged in a disconnect socket 214 of a type which is well-known. One example is disclosed in U.S. Pat. No. 2,767,349. The "hot lead" 234 does not extend directly from the interior of the ballast 222 to the line terminal 48 but instead is external of the ballast 222, being connected from the line terminal 48 to the third contact 262 of the socket 214. The right hand end of the second to ignite lamp L2 is engaged in a disconnect socket 220, only two contacts of which are used. Lead 42 connects to one of the regular contacts 264 of socket 220 while the lead 40 connects to the shunting contact 266. The regular contact 268 engaged by the shunting contact 268 is not used.

The left hand end of the lamp L1 must be fully in place in its socket 214 before the circuit 200 can be energized and even if the circuit is energized, the right hand lamp L2 must be twisted in socket 220 before filament f4 can produce clouds of electrons for starting. Lamp L2 will not start if a person holds the left hand pins and touches the right hand end pins to contacts 264 and 268 because the filaments f4 will not be energized until the lamp L2 is twisted to establish contact between contact 268 and contact 266.

Circuit 200 is very desirable because the construction of the ballast 222 is practically conventional but having only seven leads instead of the normal eight. The lead 234 is connected by the electrician installing the fixture carrying the circuit 200 according to the diagram carried on the ballast label. Plate 12 is part of the fixture.

Circuit 200 uses one line-opening disconnect socket 214 and one filament-opening disconnect socket 220. Circuit 300 of FIG. 3 uses two filament opening disconnect sockets. In the circuit 200 if lamp L1 is in the circuit and lamp L2 is held at its right hand and while the left hand pins are inserted into socket 18 touching both contacts there could be some minor shock hazard due to currents flowing through condenser C2 but absent the energizing of the filament f4 thus would not be harmful.

Circuit 300 uses a ballast 322 which is identical to ballast 22 of circuit 10. It therefore has all eight of the conventional lead wires. The right hand socket 320 is the same as socket 220 of circuit 200 of FIG. 2 and is connected in the identical manner. Both jumpers are in place between filaments f2 and f3 because both are energized from single winding F2-3. One lead 36 from the filament winding F2-3 extends to the shunting contact 370 of socket 316 to prevent energizing of both of filaments f2 and f3 unless lamp L1 is fully turned in the socket 316.

Figure 3:
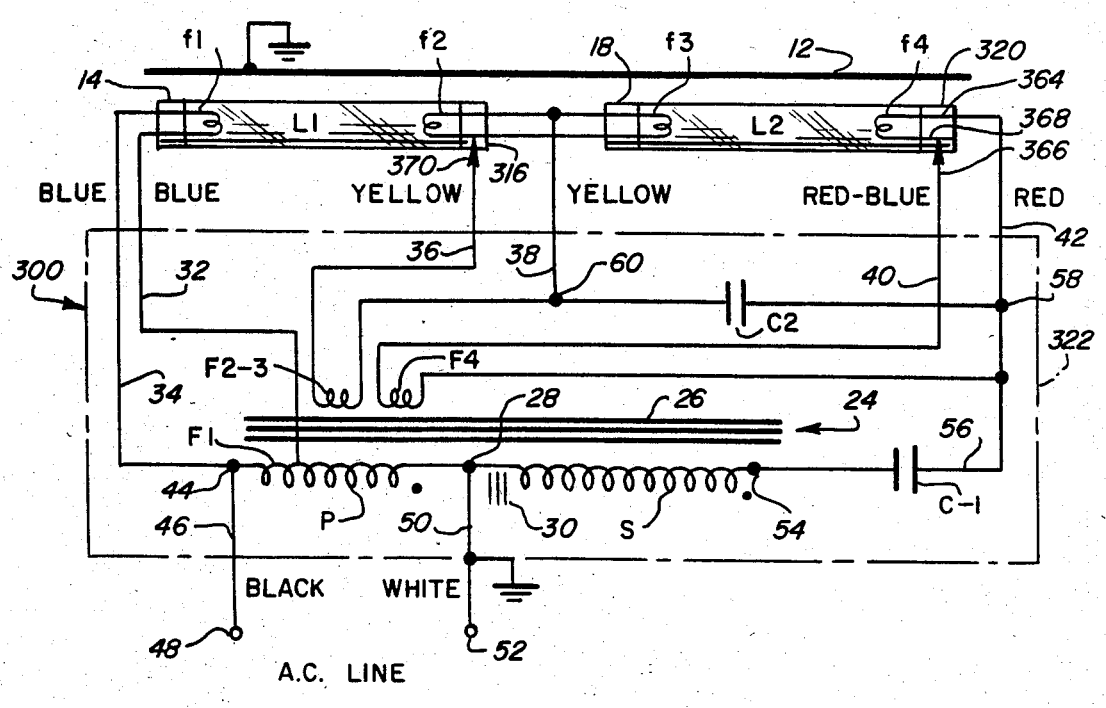
FIG. 3 is a circuit diagram of another embodiment of the invention.
Figure 3A:
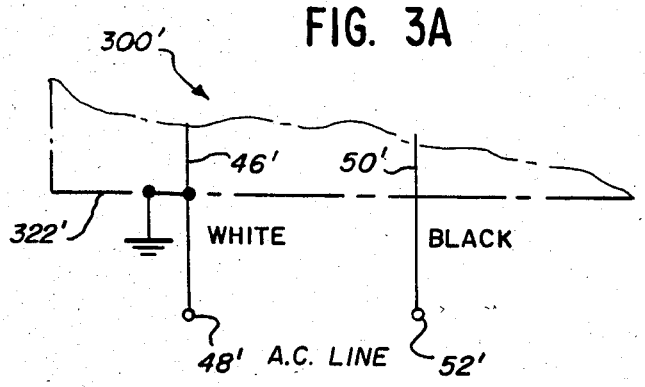
FIG. 3A is a fragmentary circuit diagram showing a modification of the embodiment of FIG. 3.

The circuit 300' of FIG. 3A is identical to the circuit 300 of FIG. 3 except for the fact that leads 46' and 50' extend to terminals 48' and 52' so grounding conditions are reversed from those of circuit 300.

The reasoning for preventing fatal shock hazard applied to the circuit 200 of FIG. 2 is equally applicable to the circuit 300 of FIG. 3. In the case of circuit 300 the disconnect sockets 316 and 320 both keep the connections to filaments open until the respective lamps are fully turned in their sockets. As such the safety of this circuit is somewhat better than that of circuit 200.

Both circuits of the invention use substantially conventional two-lamp rapid start fluorescent ballasts and as such are highly economical.

Modifications are capable of being made without departing from the spirit or scope of the invention as defined in the appended claims.

What it is desired to secure by Letters Patent of the United States is:

We claim:

1. A circuit for igniting an operating a pair of rapid start fluorescent lamps from a low voltage source in a series-sequence arrangement and which includes a ballast having a transformer with a primary winding and a secondary winding connected in additive autotransformer relationship and the transformer constructed to provide a high leakage reactance during operation thereof, a pair of rapid start fluorescent lamps, an operating condenser, a starting condenser, and a metallic fixture, the fixture mounting four sockets for holding the lamps, each lamp extending between a pair of sockets, the transformer including three filament windings closely coupled to the primary winding and there being a filament in each end of each lamp, the lamps and transformer being connected such that the lamps, primary and secondary windings and the operating condenser are connected in a series loop with the starting condenser shuntig a lamp, the fiament windings being connected to energize the filaments of the lamps with one filament (f2,f3) of each lamp being connected in parallel with each other and with a common filament winding of the ballast transformer, one of each pair of sockets being of a disconnect type, one disconnect socket adapted to interrupt the connection between the non-parallel connected filament (f4) of the starting condenser shunted lamp until it is fully seated in said one disconnect socket, the other disconnect socket adapted to prevent ignition of the other lamp disposed in said other disconnect socket unless fully seated therein, said other disconnect socket adapted to interrupt the connection between a filament of the other lamp and the filament winding energizing the same unless the second lamp is fully seated in said second disconnect socket, thereby opening the filament transformer circuit.

2. The invention as claimed in claim 1 in which there is a first-to-ignite lamp and a second-to-ignite lamp, the starting condenser being shunted across the second-to-ignite lamp, there being a first filament winding adapted to extend connection to the first fiament of the first-to-ignite lamp, there being a second filament winding adapted to extend connection to the second filament of the first-to-ignite lamp and the first filament of the second-to-ignite lamp, there being a third filament winding adapted to extend connection to the second filament of the second-to-ignite lamp, the one disconnect socket being associated with the second filament of the second-to-ignite lamp and the second disconnect socket being associated with the second filament of the first-to-ignite lamp.

3. A circuit for igniting and operating a pair of rapid start fluorescent lamps from a low voltage a.c. source in a series-sequence arrangement and which includes a ballast having a primary winding and a secondary winding connected in autotransformer relationship with the windings additive and the transformer constructed to provide a high leakage reactance during operation thereof, a pair of rapid start fluorescent lamps of starting and operating characteristics related to the paramenters of said windings and transformer such that the open circuit voltage of the combined primary and secondary windings is insufficient to ignite both lamps in series but is sufficient to ignite a single lamp and the operating voltage of the combined primary and secondary windings is sufficient with both lamps ignited to sustain operation of the lamps in series, the ballast being mounted to a metal fixture which is grounded and said source having one terminal thereof which is grounded, said pair of rapid start fluorescent lamps comprising a first-to-ignite lamp (L1) and a second-to-ignite lamp (L2) in said circuit and being connected in a series loop with the transformer windings and including a running condenser in said loop with a starting condenser shunting the second-to-ignite lamp, each lamp having a filament at each end thereof extending to a pair of external contact pins at its respective ends, four lamp sockets mounted to said fixture and each socket receiving a pair of pins therein to establish metallic engagement between the pins and respective contact terminals of each socket, the sockets being arranged to receive a lamp between each pair of sockets, three filament windings closely coupled to said primary winding and each filament winding having a pair of leads adapted to extend from the ballast interior to the socket terminal contacts to enable energizing of said filaments when the primary winding is energized from said source, there being a first filament winding (f1) having its pair of leads adapted to extend to a socket receiving one end of the first-to-ignite lamp, a second filament winding (f2-3) having its pair of leads adapted to extend to the socket receiving the second end of the first-to-ignite lamp and additionally adapted to extend to the socket receiving the first end of the second-to-ignite lamp whereby the second filament winding is adapted to be connected to the second filament of the first-to-ignite lamp and the first filament of the second-to-ignite lamp, a third filament winding (f4) having its pair of leads adapted to extend to the socket receiving the second end of the second-to-ignite lamp, each of two of sa,id sockets having a disconnect contact of the type which provides for electrical connection to one of its pair of contact pins through a metallic member that is normally not connected to said one pin but will connect when the lamp pins are engaged in said socket, each disconnect contact being connected to a third contact terminal of its socket, one socket with disconnect contact being disposed to receive the second end of the second-to-ignite lamp with the disconnect contact interrupting one of the pair of leads from the third filament winding, said one lead being connected to said third terminal contact and the other of said pair of leads being connected to that one of the socket terminal contacts not adapted to have connection with said disconnect contact, the second socket with disconnect contact being disposed to receive one end of the first-to-ignite lamp and arranged to prevent ignition of the first-to-ignite lamp unless the lamp is fully seated in its pair of sockets.

4. The invention as claimed in claim 3 in which the second socket with disconnect contact is disposed to receive the second end of the first-to-ignite lamp with the disconnect contact interruting one of the pair of leads from the second filament winding to prevent said second filament winding from reaching ignition temperature.

5. The invention as claimed in claim 3 in which the second socket with disconnect contact is disposed to receive the first end of the first-to-ignite lamp, the pair of leads of said first filament winding is connected to the two external contact terminals of said socket, and lead means are provided for extending a connection from one terminal of said source to a terminal end of said primary winding through the disconnect contact of said second socket.

6. The invention as claimed in claim 5 in which the said one terminal of said source is the grounded terminal.

7. The invention as claimed in claim 5 in which said terminal end of said primary winding is connected to one of the pair of leads of the first filament winding and the lead means include a conductor wholly external of the ballast which connects with the third contact terminal of said second disconnect socket, the one of the pair of leads of said first filament winding being connected to that external contact terminal of said socket which is adapted to make electrical connection with the third contact terminal thereof.

* * * * *